US007052648B2

(12) United States Patent
Park

(10) Patent No.: US 7,052,648 B2
(45) Date of Patent: May 30, 2006

(54) METHOD FOR MANUFACTURING FLANGE FOR COMPRESSOR

(75) Inventor: Jong-Kwan Park, Daegu (KR)

(73) Assignee: Korea Sintered Metal Co., Ltd., Daegu (KR)

( * ) Notice: Subject to any disclaimer, the term of this patent is extended or adjusted under 35 U.S.C. 154(b) by 90 days.

(21) Appl. No.: 10/471,496

(22) PCT Filed: Apr. 4, 2001

(86) PCT No.: PCT/KR01/00571

§ 371 (c)(1),
(2), (4) Date: Sep. 11, 2003

(87) PCT Pub. No.: WO02/078881

PCT Pub. Date: Oct. 10, 2002

(65) Prior Publication Data

US 2004/0071582 A1 Apr. 15, 2004

(30) Foreign Application Priority Data

Mar. 28, 2001 (KR) ..... 2001-16204

(51) Int. Cl.
*B22F 3/12* (2006.01)

(52) U.S. Cl. ..... 419/38

(58) Field of Classification Search ..... 419/5, 419/38

See application file for complete search history.

(56) References Cited

U.S. PATENT DOCUMENTS

| | | | | | |
|---|---|---|---|---|---|
| 2,695,230 | A | * | 11/1954 | Haller | 419/5 |
| 3,734,723 | A | * | 5/1973 | Blasch et al. | 419/5 |
| 3,996,048 | A | * | 12/1976 | Fiedler | 419/5 |
| 4,145,798 | A | * | 3/1979 | Sarnes | 419/27 |
| 4,485,147 | A | | 11/1984 | Nishino et al. | |
| 4,584,171 | A | * | 4/1986 | Niino et al. | 419/8 |
| 4,703,620 | A | * | 11/1987 | Niino et al. | 60/260 |
| 6,080,358 | A | * | 6/2000 | Oba et al. | 419/5 |

FOREIGN PATENT DOCUMENTS

| | | |
|---|---|---|
| JP | 01-100207 | 4/1989 |
| JP | 03-138305 | 6/1991 |
| JP | 06-041612 | 2/1994 |
| JP | 2001-065458 | 3/2001 |

* cited by examiner

*Primary Examiner*—Daniel Jenkins
(74) *Attorney, Agent, or Firm*—Welsh & Katz, Ltd.

(57) ABSTRACT

To manufacture a flange for a compressor with a relief groove by using powder metallurgy in order to prevent deformation of the compressor in operation, powder material for the flange is charged into a mold; an ablative member having a melting point lower than that of the powder material is positioned at a place where a relief groove is to be formed; the flange is formed by compressing the powder material and the ablative member; and the formed flange is sintered at a temperature between the melting points of the power material and the ablative member so as to melt and remove the ablative member.

1 Claim, 4 Drawing Sheets

METHOD FOR MANUFACTURING FLANGE FOR COMPRESSOR

TECHNICAL FIELD

The present invention relates to a method for manufacturing a flange for a compressor, and more particularly to a method for manufacturing a flange for a compressor with a relief groove by using powder metallurgy in order to prevent deformation of the flange in operation.

BACKGROUND ART

A compressor is generally used in an air conditioner, a refrigerator and so on for refrigerant compression. A typical example of such a compressor is shown in FIG. 1.

Referring to FIG. 1, a stator 2 and a rotor 3 are installed in a housing 1. In the rotor 3, provided is a rotary axis 4, which is rotatably supported by upper and lower flanges 5 and 6. Also, an eccentric roller 7 is rotatably mounted in a cylinder 8 between the upper and lower flanges 5 and 6 at a lower end of the rotary axis 4.

In the compressor having such configurations, when the rotor 3 turns to rotate the rotary axis 4, the eccentric roller 7 under the rotor 3 also rotates in the cylinder 8 so as to compress refrigerant gas, which is inhaled through an inflow pipe 9 therein, at high temperature and high pressure and discharge the same out of the cylinder 8. The refrigerant gas compressed as above is then exhausted through a discharge pipe 10, which is at an upper portion of the housing 1, and then circulates in a refrigeration cycle.

The upper and lower flanges, called as main bearing and sub-bearing respectively, of the conventional compressor, which support the rotary axis, are usually made using powder metallurgy in consideration of precision, performance, price competitiveness, etc. However, because the rotary axis, which is the core of driving the compressor, is installed to pass through a hollow portion of the flange, the flange may be deformed on the occasion that the rotary axis deforms due to the driving force. This deformation of the rotary axis may not only deform the flange but also cause melted-bond or abrasion of the flange with the eccentric roller or breakdown of an oil film, which may result in deteriorating performance of the compressor and generating noise.

Recently, to prevent deformation of the flange due to the rotary axis deformation as above, there has been proposed a compressor, which has a relief groove 5*b* around a hollow portion 5*a* of the flange 5, as shown in FIG. 2. The relief groove 5*b* is generally either formed by executing a mechanical cutting process after making the flange or made using a mold in a shaping process of the powder metallurgy method. However, the former mechanical cutting process should be separately performed after molding the flange, so inevitably causing a substantial cost hike. The later using the mold requires, separately, making the mold in a shape corresponding to the relief groove. Moreover, a molding portion corresponding to the relief groove is so weak to be easily broken down or damaged, which causes lower productivity. Furthermore, since the flange manufactured according to a conventional manner has weak portions around the relief groove, sealing of the flange is not ensured, which is one of basic requirements of the flange.

DISCLOSURE OF INVENTION

The present invention is designed to overcome problems and drawbacks of the prior art. An object of the present invention is to provide a method for manufacturing a flange, which may simply efficiently form a relief groove on the flange without using any mechanical processing or additional molding.

According to the present invention, the method enables to use a conventional mold in itself. In addition, the relief groove of the flange manufactured by the method shows excellent strength and sealing, which improves reliability of the compressor employing the flange.

In order to accomplish the above object, the present invention provides a method for manufacturing a flange for a compressor, which includes the steps of charging powder material for the flange into a mold; positioning an ablative member at a place where a relief groove is to be formed, the ablative member having a melting point lower than that of the powder material; forming the flange by compressing the powder material and the ablative member; and sintering the formed flange at a temperature lower than the melting point of the power material and higher than the melting point of the ablative member so as to melt and remove the ablative member.

At this time, the ablative member may be selected in a group consisting of copper (Cu), lead (Pb), zinc (Zn), aluminum (Al), alloys thereof and reinforced plastics (FRP).

In addition, the powder material for the flange is preferably selected in a group consisting of Fe, Fe—Cu alloy and Fe—Cu—C alloy and it is also preferred that the sintering temperature is about between 1,100° C. and 1,300° C. Also preferably, the ablative member has a ring shape.

BRIEF DESCRIPTION OF THE DRAWINGS

These and other features, aspects, and advantages of preferred embodiments of the present invention will be more filly described in the following detailed description, taken accompanying drawings. In the drawings.

BEST MODES FOR CARRYING OUT THE INVENTION

Figure 3:
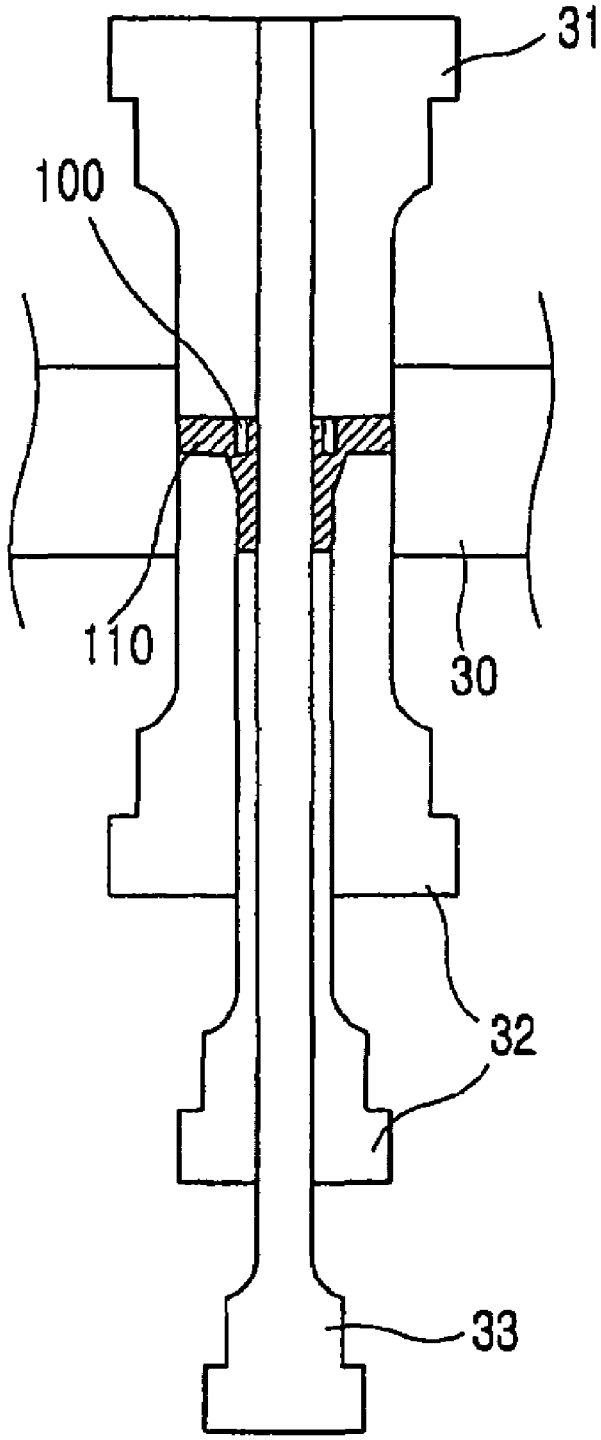
FIG. 3 is a section view for illustrating a process of forming the flange by pressure according to a preferred embodiment of the present invention.

Hereinafter, preferred embodiments of the present invention will be described in detail with reference to the accompanying drawings. The flange of the present invention may be made using a conventional mold unit, which is shown in FIG. 3. Referring to FIG. 3, the flange 100 of the present invention is formed by pressure in a mold unit, which includes a base mold 30, an upper mold 31, a lower mold 32 and a core 33. Though the mold unit is exemplarily shown and described in detail here, the configuration of the mold is not limited to that example, but any type of mold can be adopted if it can form a casting in a shape corresponding to the flange.

Figure 1:
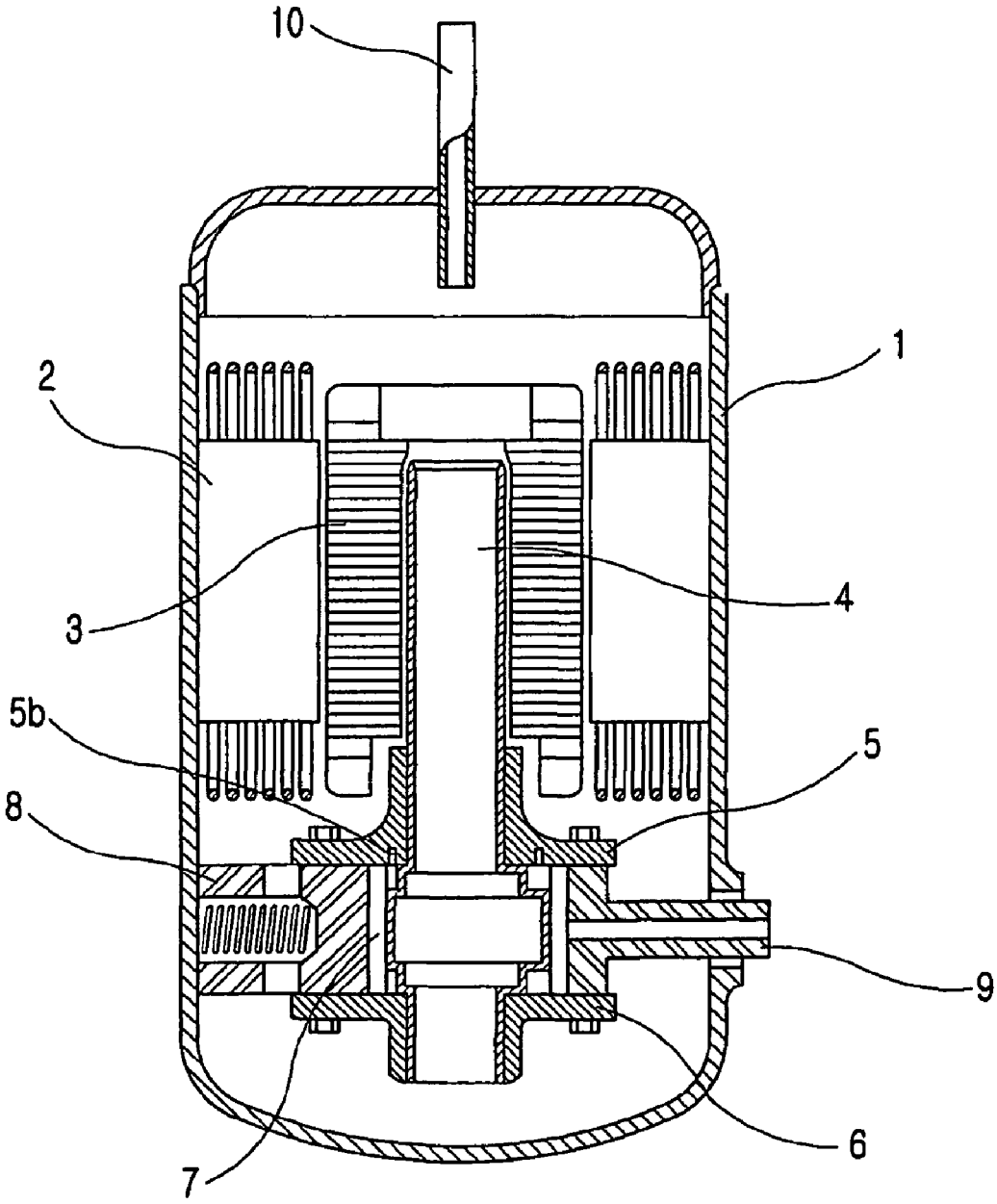
FIG. 1 is a section view showing an inner configuration of a conventional compressor.
Figure 2:
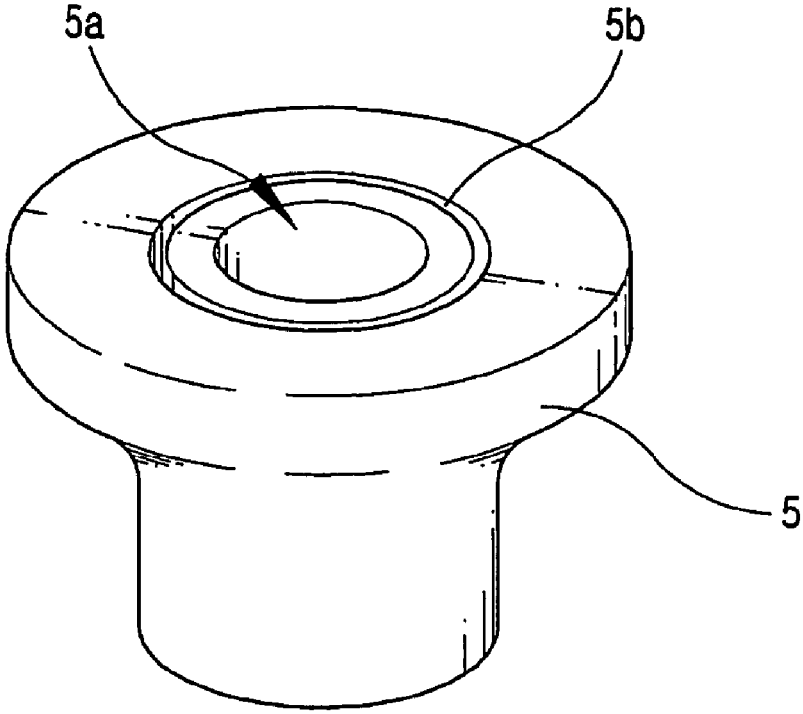
FIG. 2 is a perspective view showing a flange with a relief groove, adopted in the conventional compressor.

According to an embodiment of the present invention, an ablative member 110 is prepared at a place where a relief groove 5*b* (see FIG. 2) is to be formed, around a hollow portion of the flange 100, which is formed in the above mold unit. The ablative member 110 is melted and removed when sintering the flange 100, as described below. The ablative member 110 is made of a metal having a relatively low melting point (or, fusible metal), preferably copper (Cu: melted at 1084.5° C.), lead (Pb: melted at 327.5° C.), zinc (Zn: melted at 419.6° C.), aluminum (Al: melted at 660.4° C.), or alloys of them, in the form of ring. Alternatively, reinforced plastics (FRP) made in a ring shape can be used as the ablative member 110. In this case, the reinforced plastics may be completely oxidized and removed in the sintering procedure. Furthermore, any material having a melting point relatively lower than that of the flange 100 material so to be melt in sintering may be used as the ablative member 110, not limited to the above examples.

Material of the flange 100 may be selected among Fe, Fe—Cu alloy and Fe—Cu—C alloy, and preferably Fe—Cu—C alloy containing Cu of 0.001~5 wt %, C of 0.001~1.2 wt % and Fe, which occupies all residual percentage of the alloy. But, other impurities may be inevitably contained in the alloy during processes.

The ablative member 110 can be made by bending, cutting, forming by pressure or casting the fusible metal into a ring shape.

When sintering the formed flange 100, the fusible metal is melted and removed to create the relief groove around the hollow portion of the flange 100.

Figure 4:
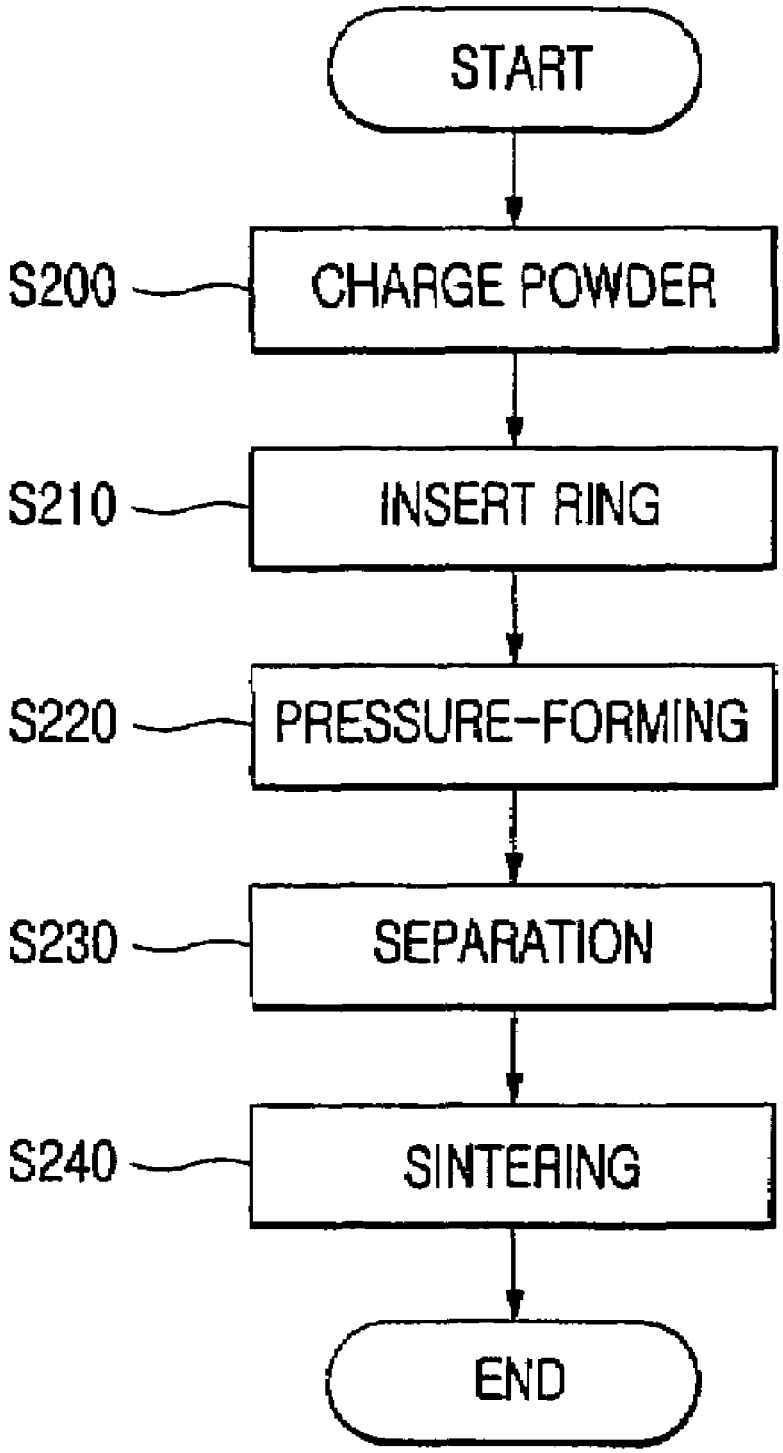
FIG. 4 is a flow chart for illustrating a method for manufacturing the flange according to the present invention.

Now, a method for manufacturing the flange for a compressor having configuration as above is described in detail with reference to FIGS. 3 and 4.

An appropriate amount of powder material, for example included in Fe—Cu—C alloy, is charged in the mold unit, shown in FIG. 3, having the base mold 30, the lower mold 32 and the core 33. (step S200) The powder material for the flange is prepared by mixing appropriate amounts of Fe, Cu and C. At this time, the core 33 is inserted into the hollow portion of the flange.

With the powder material charged in the mold, the ablative member 110 of a fusible metal in a ring shape is positioned at a target around the hollow portion. (step S210)

Then, the assembled upper mold 31 is compressed at a high pressure to mold the flange. (step S220)

When the flange is molded as desired, the molded flange is separated from the mold unit. (step S230) At this time, the hollow portion is formed in the flange 100, and the ablative member 110 is embedded to be exposed to the outside around the hollow portion in a ring shape.

After that, the flange 100 is sintered in a sintering furnace at a temperature between 1100° C. and 1300° C., preferably between 1100° C. and 1160° C. (step S240) In this sintering process, the ablative member of a fusible metal is melted to flow down and removed. However, the fusible metal is partially penetrated into the flange structure, which causes improvement of the flange sealing.

Throughout the above procedure, the flange that has a relief groove in a ring shape around the hollow portion is obtained. Though the ablative member is shown and described to be in a ring shape, the present invention is not limited to that case. The spirit of the present invention is highlighted on the point that an ablative member having a shape corresponding to the relief groove with a relatively low melting point is positioned in the mold beforehand, pressure-formed together with the powder material for the flange, and then removed in the sintering process. Therefore, the ablative member may have a continuous or discontinuous configuration, which will also form a relief groove with a continuous or discontinuous shape, respectively.

The method for manufacturing the flange for a compressor according to the present may be proved effective based on the below-described experimental example.

EXPERIMENTAL EXAMPLE 1.5 wt % of Cu powder having an average particle size of 45 μm, 0.8 wt % of C powder having an average particle size of 10 μm and the balance of Fe powder having an average particle size of 100 μm are mixed and charged into a mold. Then, the ring-shaped ablative member made of Cu having a purity of 99.9 wt % is positioned around the hollow portion. Then, the mold is compressed together with the ablative member at a pressure of 6 ton/cm$^2$ to form a flange of the present invention, which is 90 mm in diameter and 50 mm in height. After that, the flange is charged into a sintering furnace and heated at 1,130±30° C. for 30 minutes to melt and remove the ablative member. Through the above procedure, the relief groove having an outer diameter of 27 mm, an inner diameter of 23 mm and 10 mm in depth is completed.

On the other hand, the prior art forms a relief groove with same size as that of the present invention in the conventional flange through compression and sintering processes using a common mold and then a mechanical cutting process.

To compare the flanges of the prior art and the present invention, a taper cone jig is inserted into the hollow portion of each flange. The hollow portion of each flange having the taper cone jig is then loaded for destructive test of the relief groove. In addition, the flanges are installed to a test jig and then a pressure of 20 kg/cm$^2$ is exerted to the test jig by nitrogen. Experimental results are shown in Table 1.

TABLE 1

| | Strength | Airtight |
|---|---|---|
| Flange of Prior art | destructed at 500 kg | gas pressure decreases within 3 min. |
| Flange of Present invention | destructed at 600 kg | no decrease of gas pressure during 5 min. |

With reference to the results in Table 1, it is easily known that the flange made according to the present invention has more excellent strength and airtight property than the conventional one. It is analyzed that the ablative member is melted and penetrated into the flange structure during the sintering process, which results in improvement of the airtight property and increase of the strength.

The method for manufacturing a flange for a compressor according to the present invention may use a mold, which is commonly used in the prior art. This may save money needed to make another mold for forming the relief groove.

In addition, the present invention may form the relief groove by simply inserting an ablative member in the flange pressure-forming process, and melting and removing the ablative member in the sintering process without any mechanical processing like the prior art, which may increase productivity dramatically as well as give sharp decrease of the manufacturing costs.

Furthermore, a metal with a relatively low melting point or a fusible metal is permeated into the flange structure during implementing the method of the present invention, so resulting in strength improvement and airtight property increase of the flange structure. These may promote quality reliability very remarkably.

The method for manufacturing a flange of a compressor according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A method for manufacturing a flange for a compressor, the flange having a relief groove around a hollow thereof, the method comprising the steps of:

manufacturing an ablative member having a ring shape with a diameter greater than the diameter of the hollow, the ablative member selected from the group consisting of copper (Cu), lead (Pb), zinc (Zn), aluminum (Al), alloys thereof and reinforced plastics (FRP);

charging powder material of Fe—Cu—C for the flange into a mold;

positioning an ablative member on the upper surface of the charged powder material and around the hollow where a relief groove is to be formed;

forming the flange by compressing the powder material and the ablative member; and sintering the formed flange at a temperature between 1,100 degrees C. and 1,300 degrees C. so as to melt and remove the ablative member.

* * * * *